United States Patent [19]

Vakil et al.

[11] 4,217,760

[45] Aug. 19, 1980

[54] VAPOR COMPRESSION CYCLE DEVICE WITH MULTI-COMPONENT WORKING FLUID MIXTURE AND METHOD OF MODULATING ITS CAPACITY

[75] Inventors: Himanshu B. Vakil; John W. Flock, both of Schenectady, N.Y.

[73] Assignee: General Electric Company, Schenectady, N.Y.

[21] Appl. No.: 926,510

[22] Filed: Jul. 20, 1978

[51] Int. Cl.[2] ..... F25B 1/00; F25B 41/00; F25B 43/00

[52] U.S. Cl. ..... 62/114; 62/115; 62/174; 62/503; 62/512

[58] Field of Search ..... 62/114, 502, 503, 509, 62/512, 174

[56] References Cited

U.S. PATENT DOCUMENTS

| | | | |
|---|---|---|---|
| 2,277,138 | 3/1942 | Newton | 62/114 X |
| 2,492,725 | 12/1949 | Ashley | 62/115 |
| 2,682,756 | 7/1954 | Clark et al. | 62/502 X |
| 2,794,322 | 6/1957 | Etherington | 62/114 |
| 2,794,328 | 6/1957 | Herrick | 62/509 X |
| 2,807,943 | 10/1957 | Lynch et al. | 62/115 |
| 2,986,898 | 6/1961 | Wood, Jr. | 62/512 X |
| 3,237,422 | 3/1966 | Pugh | 62/174 X |
| 3,500,656 | 3/1970 | Lofgreen et al. | 62/503 X |
| 3,636,723 | 1/1972 | Kramer | 62/503 |
| 4,003,215 | 1/1977 | Roach | 62/476 |

*Primary Examiner*—Lloyd L. King

*Attorney, Agent, or Firm*—Robert R. Schroeder; James C. Davis, Jr.; Paul R. Webb, II

[57] ABSTRACT

A vapor compression cycle device is described which includes a multi-component working fluid mixture, a high-pressure liquid accumulator with an associated flow restricting device positioned between the condensing heat exchanger and the evaporating heat exchanger, and a low-pressure liquid accumulator positioned between the evaporating heat exchanger and the compressor. A method is also described of modulating the capacity of such a device.

4 Claims, 3 Drawing Figures

VAPOR COMPRESSION CYCLE DEVICE WITH MULTI-COMPONENT WORKING FLUID MIXTURE AND METHOD OF MODULATING ITS CAPACITY

This invention relates to a vapor compression cycle device and to a method of modulating its capacity and, more particularly to such a device with a multi-component working fluid mixture and to a method of modulating its capacity.

A single refrigerant heat pump is described in U.S. Pat. No. 2,807,943 issued Oct. 1, 1957, under the title "Heat Pump Including Means For Controlling Effective Refrigerant Charge". The heat pump of the subject patent includes a refrigerant container positioned between the indoor heat exchanger and the flow restricting means for charging the effective refrigerant charge in the circuit.

A mixed refrigerant system is described in U.S. Pat. No. 2,492,725 issued Dec. 27, 1949, under the title "Mixed Refrigerant System". The subject heat pump includes a liquid receiver and expansion valve between the outdoor heat exchanger and the indoor heat exchanger.

A refrigerant system is described in U.S. Pat. No. 4,003,215, under the title "Absorption Refrigeration System". The subject system utilizes a pair of fluorocarbon compounds in which one fluid is separated from the other fluid by a distillation process. The separated fluid is circulated through the refrigeration system.

Our present invention is directed to a vapor compression cycle device which is opposed to the above patents in that it includes a multi-component working fluid mixture, a high-pressure liquid accumulator with an associated flow restricting device positioned between the condensing heat exchanger and the evaporating heat exchanger, and a low-pressure liquid accumulator positioned between the evaporating heat exchanger and the compressor.

The primary objects of our invention are to provide an improved vapor compression cycle device with a multi-component working fluid mixture, and to provide a method of modulating the capacity of such a device whether operating in a heating or a cooling mode.

In accordance with one aspect of our invention, a vapor compression cycle device with a multi-component fluoro-carbonworking fluid mixture includes a high-pressure accumulator with an associated flow restricting device positioned between the condensing heat exchanger and the evaporating heat exchanger, and a low-pressure liquid accumulator positioned between the evaporating heat exchanger and the compressor.

Figure 1:
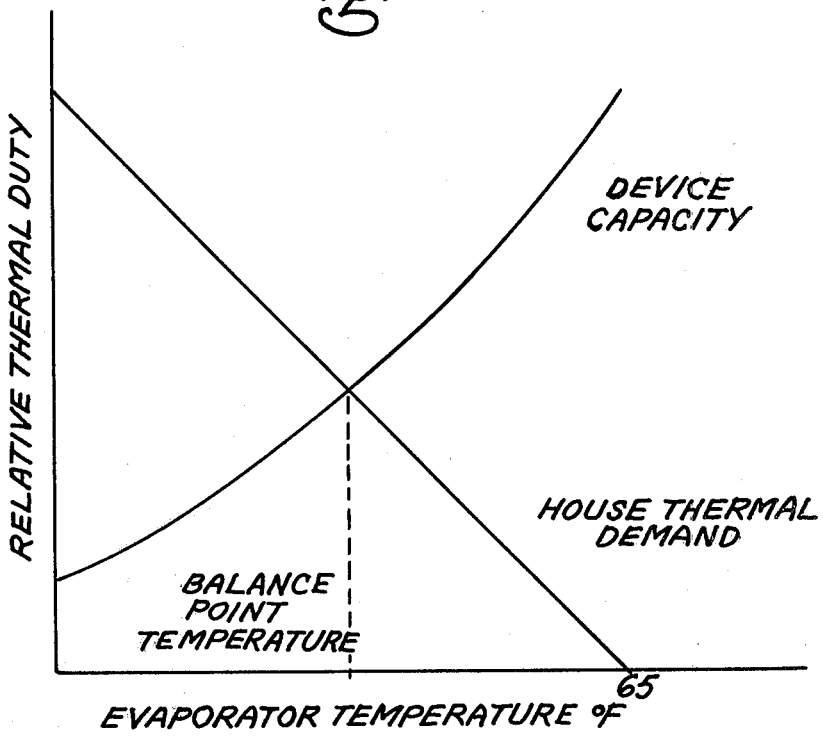
Figure 3:
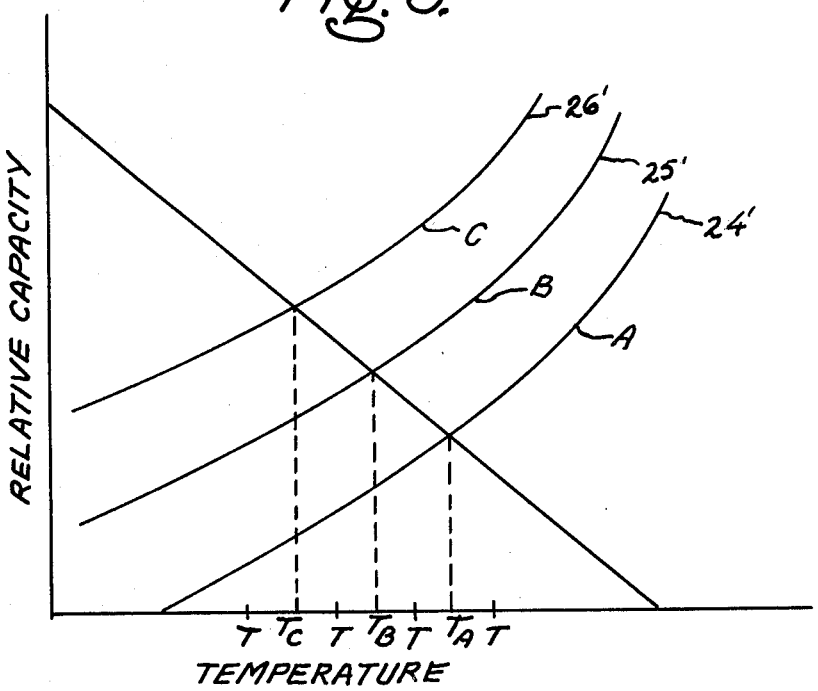
Figure 2:
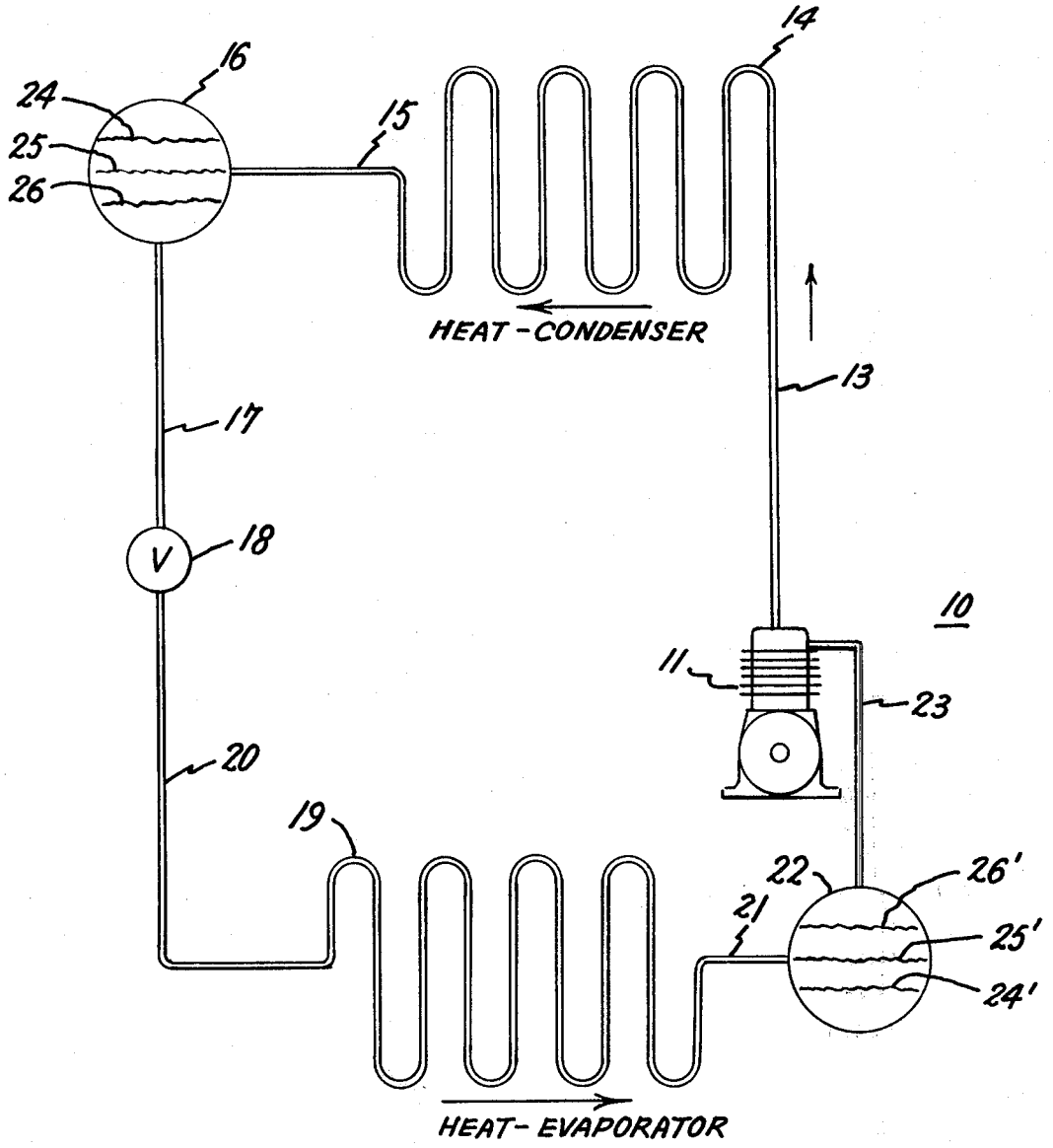

These and various other objects, features and advantages of the invention will be better understood from the following description taken in connection with the accompanying drawing in which:

FIG. 1 of the drawing is a schematic graph exhibiting a typical contrast between the house thermal demand and the heating capacity of a vapor compression cycle device operating in the heating mode as a function of evaporator temperature;

FIG. 2 is a schematic view partially in section of a vapor compression cycle device made in accordance with our invention; and FIG. 3 is a schematic graph demonstrating relative capacity versus evaporator temperature in our method of modulating the capacity of our vapor compression cycle device.

In FIG. 1, which is a schematic graph, there is exhibited a typical contrast between the house thermal demand and vapor compression cycle device capacity as a function of evaporator temperature. Conventional device designs suffer from a major disadvantage in the capacity versus evaporator temperature characteristics of the devices. Ideally, one would like the device to have a capacity versus evaporator temperature characteristic resembling that of the house. Unfortunately, in case of existing devices there is a wide mismatch in the two characteristics. As consequences, above the balance point temperature there are two sources of inefficiencies; one existing from an overloading of the heat exchangers that operate with high temperature differences resulting in associated thermodynamic penalties, and the other arising out of the startup and shutdown transients resulting from a reduced operational duty factor. Below the balance point temperature, additional inefficiencies result from the necessity to utilize additional heating at associated low efficiencies in order to make up the difference between the house demand and the device supply.

Our invention provides an improved vapor compression cycle device that has a higher capacity for a lower evaporator temperature over the bulk of heating season.

In FIG. 2 of the drawing, there is shown a vapor compression cycle device 10 with a multi-component working fluid mixture made in accordance with our invention. Device 10 in the heating mode has a compressor 11 for the working fluid mixture. Tube 13 connects compressor 11 to the inlet side of condensing heat exchange 14. Tube 15 connects the outlet side of condensing heat exchanger 14 to a high-pressure liquid accumulator 16. Tube 17 connects accumulator 16 to an expansion valve 18. An evaporating heat exchanger 19 is connected to expansion valve 18 by a tube 20. A tube 21 connects the outlet side of exchange 19 to a low-pressure liquid accumulator 22. Compressor 11 is connected to the outlet side of accumulator 22 by a tube 23. Thus, a closed system is provided containing a multi-component mixed working fluid that flows cyclicly through the entire system.

In high-pressure liquid accumulator 16, three different liquid levels 24, 25 and 26 are shown which exist at different stages of the heating mode which will be discussed below in more detail. Similarly, in accumulator 22, three different liquid levels 24', 25', and 26' are shown which exist at different stages of the heating mode which will be discussed below in more detail.

Our vapor compression cycle device has improved capacity versus evaporator temperature characteristics. We have provided an improved device with a high-pressure liquid accumulator with an associated flow-restricting device positioned between the condensing heat exchanger and the evaporating heat exchanger, and a liquid accumulator positioned between the evaporating heat exchanger and the compressor. We have provided also a method of modulating the capacity of such a device. Our device matches the house thermal demand over a range of evaporator temperatures. This range can be selected to give maximum benefit during the bulk of heating season by reducing vastly the disadvantages inherent in auxilliary heating below conventional balance point temperatures and thermal degradation through heat exchanger overloading above the balance point temperatures which is shown in FIG. 1 of the drawing.

Various multi-component working fluid mixtures can be employed. Such mixtures, which have two or more components, must have different vapor pressures and the mixture components must be miscible over the range of operation. We prefer multi-component fluorocarbon working fluid mixtures. Such multi-component fluoro-carbon working fluid mixtures can be selected from such mixtures described in above-referenced U.S. Pat. No. 4,003,215. As opposed to this patent wherein one working fluid is separated from the other working fluid by distillation prior to circulation in the refrigerant system, the present vapor compression cycle device circulates the working fluids as a mixture. The capacity versus evaporator temperature characteristics of a single component working fluid is limited by the dependence of the working fluid vapor pressure on the temperature of the evaporator heat exchanger. The present invention uses advantageously changes in the composition of the mixed working fluid to alter the compressor molar flow rate to accomodate the changes in evaporator temperature.

During the heating mode of vapor compression cycle device 10, compressor 11 circulates mixed working fluid vapor through tube 13 to condensing heat exchanger 14. The mixed working fluid flows from heat exchanger 14 through tube 15 to a high-pressure accumulator 16. A flow restricting device in the form of an expansion valve 18 controls the flow of the mixed working fluid liquid from accumulator 16 through tube 17, valve 18 and tube 20 to evaporator heat exchanger 19. The mixed working fluid vapor and liquid flows from heat exchanger 19 through tube 21 to low-pressure accumulator 22. Compressor 11 receives the mixed working fluid mostly as vapor from accumulator 22 through tube 23 to complete the heating mode.

As it is shown in FIG. 2 of the drawing, high-pressure accumulator 16 has mixed working fluid levels 24, 25, and 26 indicated schematically. In low-pressure accumulator 22, the mixed working fluid levels are shown as 24', 25', and 26'. When level 24, 25 or 26 is accomplished in high-pressure accumulator 16, the increasing level of the mixed working fluid in the accumulator 22 is 24', 25' or 26'. The following description will discuss how these levels are achieved and their effect on modulating the capacity of the vapor compression cycle device during its heating mode. At a high evaporator temperature for the heating mode, as shown in FIG. 1 of the drawing, expansion valve 18 in FIG. 2 of the drawing is controlled by conventional equipment to adjust the flow rate of the mixed working fluid 24 from accumulator 16 whereby a level 24 of working fluid is attained in accumulator 16. This control of expansion valve 18 will deplete the mixed working fluid in accumulator 22 to a level shown as 24'. In this manner, the mixed working fluid liquid in low-pressure accumulator 22 is enriched in the high boiling point working fluid component and its vapor pressure is reduced to its lowest level. This results in the lowest molar flow rate through the compressor and hence the lowest capacity for this evaporator temperature. As the evaporator temperature drops, exchange valve 18 is controlled to allow increasing quantities of the mixed working fluid from high-pressure accumulator 16 to pass through heat exchanger 19 into accumulator 22 thereby providing a level shown as 25'. This increase in flow of the mixed working fluid from accumulator 16 through exchanger 19 to accumulator 22 enriches the working fluid in the lighter or lower boiling point working fluid component. The total pressure in accumulator 22 increases with a resulting increase in the device capacity and in the molar flow rate through compressor 11. As the temperature continues to drop, exchange valve 18 allows the liquid in accumulator 16 to fall to a level 26 and increases the level in accumulator 22 to 26'. In this manner, the process of increasing or enriching the refrigerant in its lower boiling point component is continued. This increases the compressor inlet density with increased molar pumping flow rate of the compressor. As the temperature drops further, exchange valve 18 allows all of the working fluid liquid in accumulator 16 to be depleted, which working fluid passes through exchanger 19 and into accumulator 22 with an associated increase in the molar pumping flow rate of the compressor to its maximum value yielding the maximum device capacity for this lower evaporator temperature. Thus, our device modulates its capacity versus the evaporator temperature to match thermal demand. As the evaporator temperature increases in the heating mode, modulation is obtained by initially decreasing the flow rate of the mixed working fluid from accumulator 16 which is controlled selectively by flow restricting device 18. In this manner, the mixed fluid level in accumulator 22 may be restored to level 25' or 24' in response to increasing evaporator temperatures.

In FIG. 3 of the drawing, the schematic graph demonstrates the flexibility of capacity modulation of our heat pump. "A", "B", and "C" represent vapor compression cycle device capacity curves corresponding to successively increasing liquid levels in the low-pressure accumulator. "$T_A$", "$T_B$", and "$T_C$" represent three balance point temperatures in descending temperatures. The "T's" represent various evaporator temperatures during the heating mode of the device.

For the purpose of a direct comparison of the present device with a one-component device, curve B is the equivalent of a single component device capacity curve. The advantages of this invention are evident in the following comparisons in each of the four temperature ranges:

$T > T_A$: The lower capacity of curve A implies savings due to a reduced loading of the heat exchangers and a reduced cycling loss.

$T_A > T > T_B$: There is no on-off cycling of the multi-component device and, furthermore, the heat exchanger overloading is eliminated.

$T_B > T > T_C$: The auxilliary heating required in a one-component system is eliminated by the gradually increasing capacity of the multi-component cycle, and $T_C > T$: The auxilliary heating is reduced by the difference in capacities shown by curves C and B with resultant improvements in the overall system.

Thus, the temperature range $T_A$-$T_C$ can be chosen to encompass the bulk of the heating season by the flexibility in the number of working fluids employed and their vapor-pressure versus temperature characteristics.

Our method of modulating the capacity of our vapor compression cycle device during its heating mode includes compressing a multi-component working fluid mixture, condensing the mixture vapor, storing the mixture liquid under high pressure, controlling the flow rate of the mixture from storage in response to changes in the evaporator temperature, evaporating the mixture, storing the unevaporated mixture under low pressure, and controlling the flow rate of compression by the density of the vapor of the mixture under low-pressure storage.

In our method, we modulate the capacity of the vapor compression cycle device during its heating mode by circulation a multi-component working fluid mixture vapor from a compressor to a condenser. The liquid from the condenser is circulated to a high-pressure accumulator. The mixture is circulated from the accumulator to an evaporator. The flow of the mixture from the accumulator to the evaporator is circulated selectively in response to changes in the evaporator temperature by an associated flow restricting device. The mixture is then flowed to a low-pressure accumulator. The density of the vapor in equilibrium with the liquid mixture in the low-pressure accumulator controls the rate of compression or the molar flow of the mixture to and through the compressor.

At higher evaporator temperatures, the mixture flow is reduced or restricted but as the evaporator temperature decreases, the flow from the high-pressure accumulator is increased. As the level in the high-pressure accumulator decreases, the mixture level in the low-pressure accumulator increases. The increase in working fluid mixture in the low-pressure accumulator increases the vapor density. The change from a low to a higher density in the vapor in the low-pressure accumulator increases the flow rate of the mixture through the compressor with a consequent increase in the heat exchanger duties and the compressor power input.

More specifically, we modulate the capacity of our device during its heating mode by compressing a multi-component working fluid mixture, circulating the mixture vapor to a condenser, circulating the mixture liquid from the condenser to a high-pressure accumulator, circulating selectively the mixture from the accumulator to an evaporator in response to changes in evaporator temperature, circulating the mixture from the evaporator to a low-pressure accumulator, circulating the mixture from the low-pressure accumulator to the compressor, and controlling the flow rate of the mixture from the low-pressure accumulator to and through the compressor by the density of the mixture in the low-pressure accumulator.

At the higher outdoor temperatures, the restricted flow of the mixed working fluid from the high-pressure accumulator results in the mixed working fluid, which is circulated to the evaporator, being enriched in the high boiling point working fluid component. As the evaporator temperature decreases, the increase of mixture flow from the high-pressure accumulator enriches the working fluid mixture in the low boiling point working fluid component. The additional flow of working fluid mixture through the evaporator and to the low-pressure accumulator results in a pressure increase in the low-pressure accumulator thereby increasing the molar pump flowing rate of the compressor. Thus, our method provides for modulation of the capacity of our device during its heating mode.

While other modifications of the invention and variations thereof which may be employed within the scope of the invention have not been described, the invention is intended to include such as may be embraced within the following claims.

What we claim as new and desire to secure by Letters Patent of the United States is:

1. A method of modulating the capacity of a vapor compression cycle device which comprises compressing a multi-component working fluid mixture, condensing the mixture vapor, storing the mixture liquid under high pressure, controlling the flow rate of the mixture from storage, evaporating the mixture, storing the unevaporated mixture under low pressure, and controlling the flow rate of compression by the density of the mixture under low pressure.

2. A method of modulating the capacity of a vapor compression cycle device which comprises compressing a multi-component working fluid mixture, circulating the mixture vapor to a condenser, circulating the mixture liquid from the condenser to a high-pressure accumulator, controlling the circulation of the mixture from the accumulator to an evaporator, circulating the mixture from the evaporator to a low-pressure accumulator, circulating the mixture from the low-pressure accumulator to the compressor, and controlling the flow rate of the mixture from the low-pressure accumulator to and through the compressor by the density of the vapor of the mixture in the low-pressure accumulator.

3. A method of modulating the capacity of a vapor compression cycle device as in claim 2, in which the flow of the working fluid mixture liquid from the high-pressure accumulator to the evaporator is reduced at higher evaporator temperatures, and the flow of the refrigerant mixture liquid from the high-pressure accumulator to the evaporator is increased as the evaporator temperature increases.

4. A method of modulating the capacity of a vapor compression cycle device as in claim 2, in which the mixture is a multi-component fluoro-carbon working fluid.

* * * * *